US008395473B1

(12) United States Patent
Huss

(10) Patent No.: US 8,395,473 B1
(45) Date of Patent: Mar. 12, 2013

(54) FUSE BOX SYSTEM

(75) Inventor: Roy A. Huss, Cleveland, NC (US)

(73) Assignee: Hussco, NC, LLC, Cleveland, NC (US)

( * ) Notice: Subject to any disclaimer, the term of this patent is extended or adjusted under 35 U.S.C. 154(b) by 440 days.

(21) Appl. No.: 12/728,981

(22) Filed: Mar. 22, 2010

Related U.S. Application Data

(63) Continuation-in-part of application No. 12/169,467, filed on Jul. 8, 2008, now Pat. No. 7,683,752, which is a continuation-in-part of application No. 11/620,243, filed on Jan. 5, 2007, now abandoned.

(51) Int. Cl.
*H01H 85/32* (2006.01)

(52) U.S. Cl. ..... 337/206; 361/626; 439/620.26

(58) Field of Classification Search ..... 337/206
See application file for complete search history.

(56) References Cited

U.S. PATENT DOCUMENTS

| | | | |
|---|---|---|---|
| 4,281,322 | A | 7/1981 | Nasu et al. |
| 4,969,063 | A | 11/1990 | Scott et al. |
| 5,002,505 | A | 3/1991 | Jones et al. |
| 5,343,192 | A | 8/1994 | Yenisey |
| 5,739,737 | A | 4/1998 | Hatton |
| 6,775,148 | B2 | 8/2004 | Hong |
| 2006/0017540 | A1 | 1/2006 | Smith |
| 2006/0285280 | A1 | 12/2006 | Shyu |

*Primary Examiner* — Michael Zarroli

(74) *Attorney, Agent, or Firm* — Kevin M. Klughart; Carstens & Cahoon, LLP

(57) ABSTRACT

A fuse box system that combines a series of specially designed fuses in a fuse box that allows an individual to see if one or more particular fuses within the fuse box are broken. The fuse has one of two different configurations, depending on whether the fuse is used in a system that is used in a polarized or non-polarized system. In each scenario, the fuse includes a number of diodes, one of which is a light emitting diode (LED) that will be lit up when the fuse is working and will not be lit up when the fuse is broken and/or not working. Another embodiment utilizes solely LEDs.

2 Claims, 8 Drawing Sheets

FUSE BOX SYSTEM

CROSS-REFERENCE TO RELATED APPLICATIONS

U.S. Pat. No. 12,169,467 filed Jul. 8, 2008 and U.S. Pat. No. 11,620,243 filed Jan. 5, 2007

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved fuse box system that combines a series of specially designed fuses in a fuse box that allows an individual to see if one or more particular fuses within the fuse box are broken.

SUMMARY OF THE INVENTION

The present invention concerns that of a new and improved fuse box system that combines a series of specially designed fuses in a fuse box that allows an individual to see if one or more particular fuses within the fuse box are broken. The fuse has one of two different configurations, depending on whether the fuse is used in a system that is used in a polarized or non-polarized system. In each scenario, the fuse includes a number of diodes, including a plurality if light emitting diode (LED) that will be lit up when the fuse is working and will not be lit up when the fuse is broken and/or not working. Another embodiment utilizes only the light emitting diodes, which reduces heat generated and voltage drop to eventually what is called the load from the other embodiment.

There has thus been outlined, rather broadly, the more important features of a fuse box system that the detailed description thereof that follows may be better understood and in order that the present contribution to the art may be better appreciated. There are, of course, additional features of the fuse box system that will be described hereinafter and which will form the subject matter of the claims appended hereto.

In this respect, before explaining at least one embodiment of the fuse box system in detail, it is to be understood that the fuse box system is not limited in its application to the details of construction and to the arrangements of the components set forth in the following description or illustrated in the drawings. The fuse box system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present fuse box system. It is important, therefore, that the claims be regarded as including such equivalent constructions insofar as they do not depart from the spirit and scope of the present invention.

It is therefore an object of the present invention to provide a fuse box system which has all of the advantages of the prior art and none of the disadvantages.

It is another object of the present invention to provide a fuse box system which may be easily and efficiently manufactured and marketed.

It is another object of the present invention to provide a fuse box system which is of durable and reliable construction.

It is yet another object of the present invention to provide a fuse box system which is economically affordable and available for relevant market segment of the purchasing public.

Other objects, features and advantages of the present invention will become more readily apparent from the following detailed description of the preferred embodiment when considered with the attached drawings and appended claims.

LEDs and illustrating that the LED is off when the fuse is good and LED is on when the fuse is broken.

Figure 6:
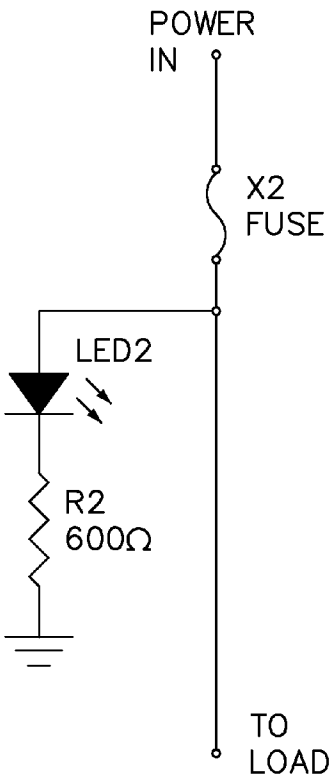
Figure 5:
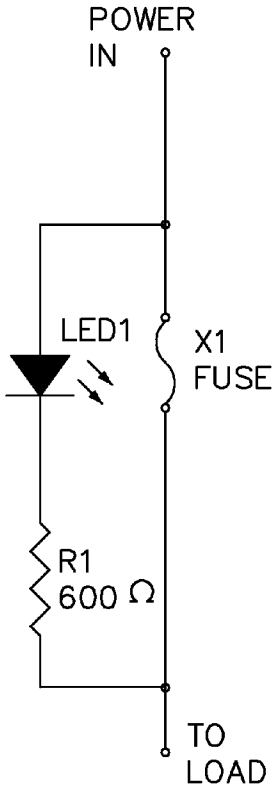
FIG. 5 is a schematic diagram for another embodiment utilizing only

FIG. 6 is a schematic diagram for the embodiment shown in FIG. 5 showing a second LED in which faulty lit LED fuse and a non-lit LED circuit that the fuse was connected to with all other box LEDs being constantly ON and the fuse LEDs off, signifying a broken circuit.

Figure 7:
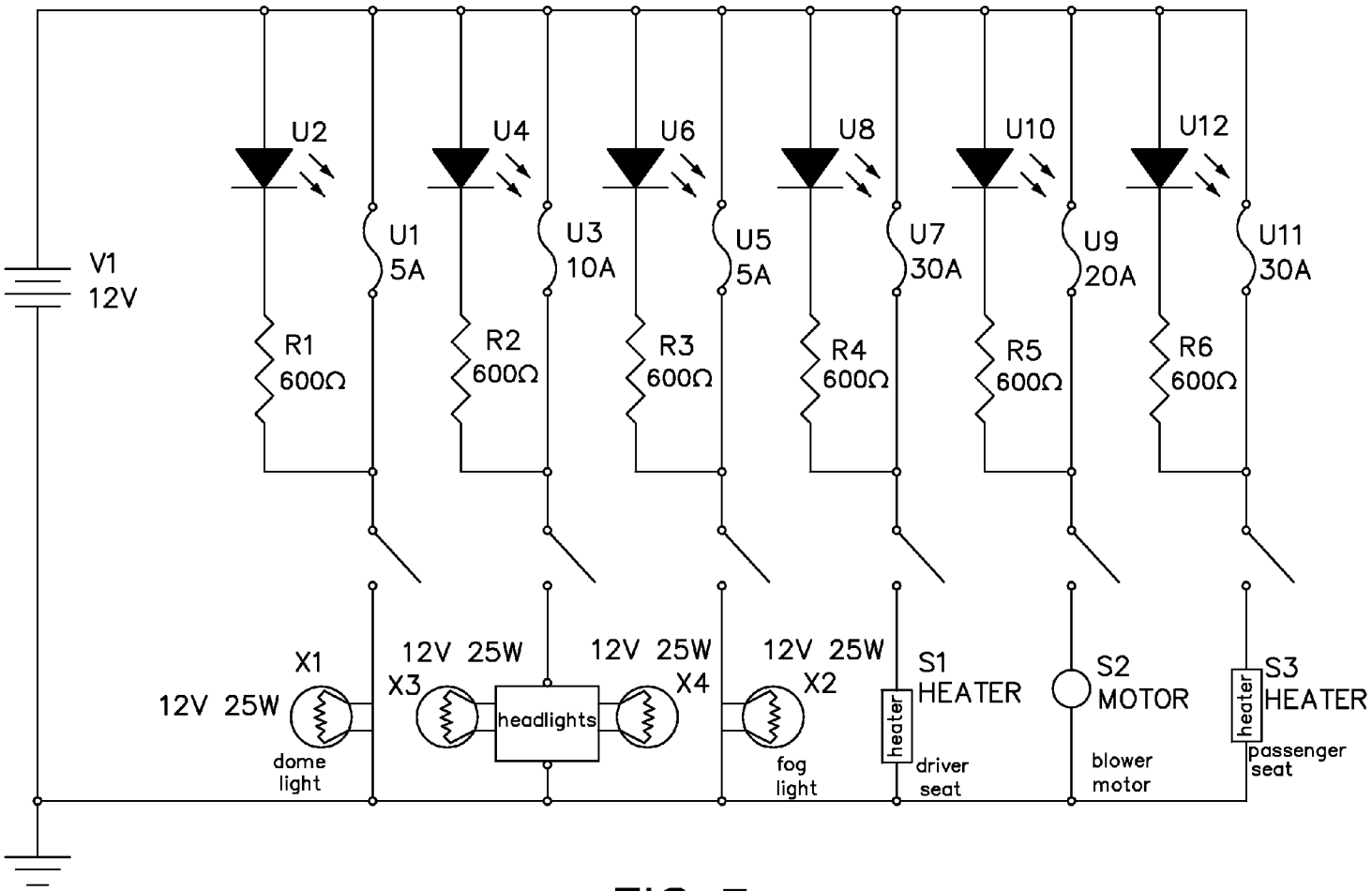

FIG. 7 is an electronic layout of the embodiment shown in FIG. 5.

Figure 8:
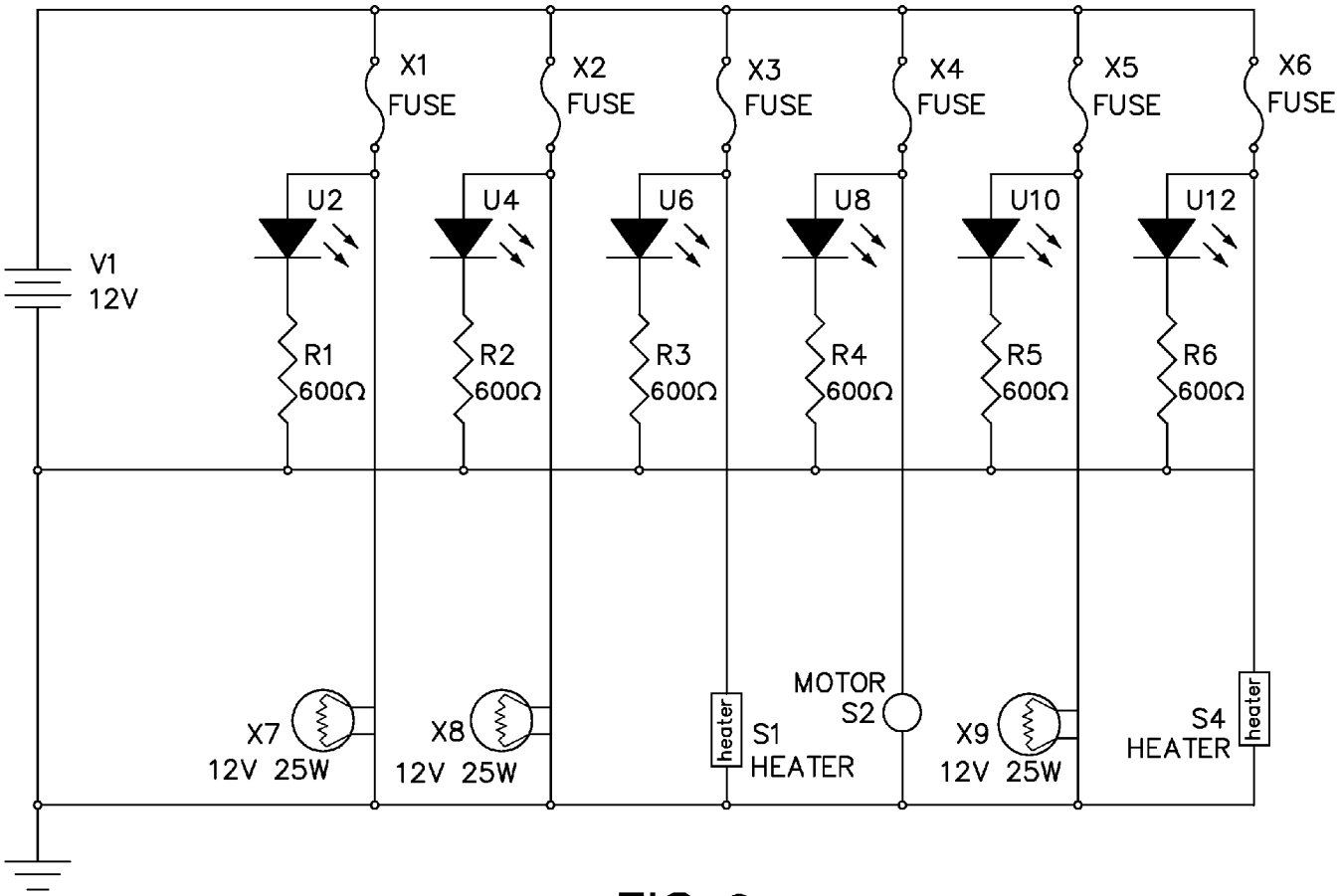

FIG. 8 is another electronic layout of the embodiment shown in FIG. 6.

Figure 9:
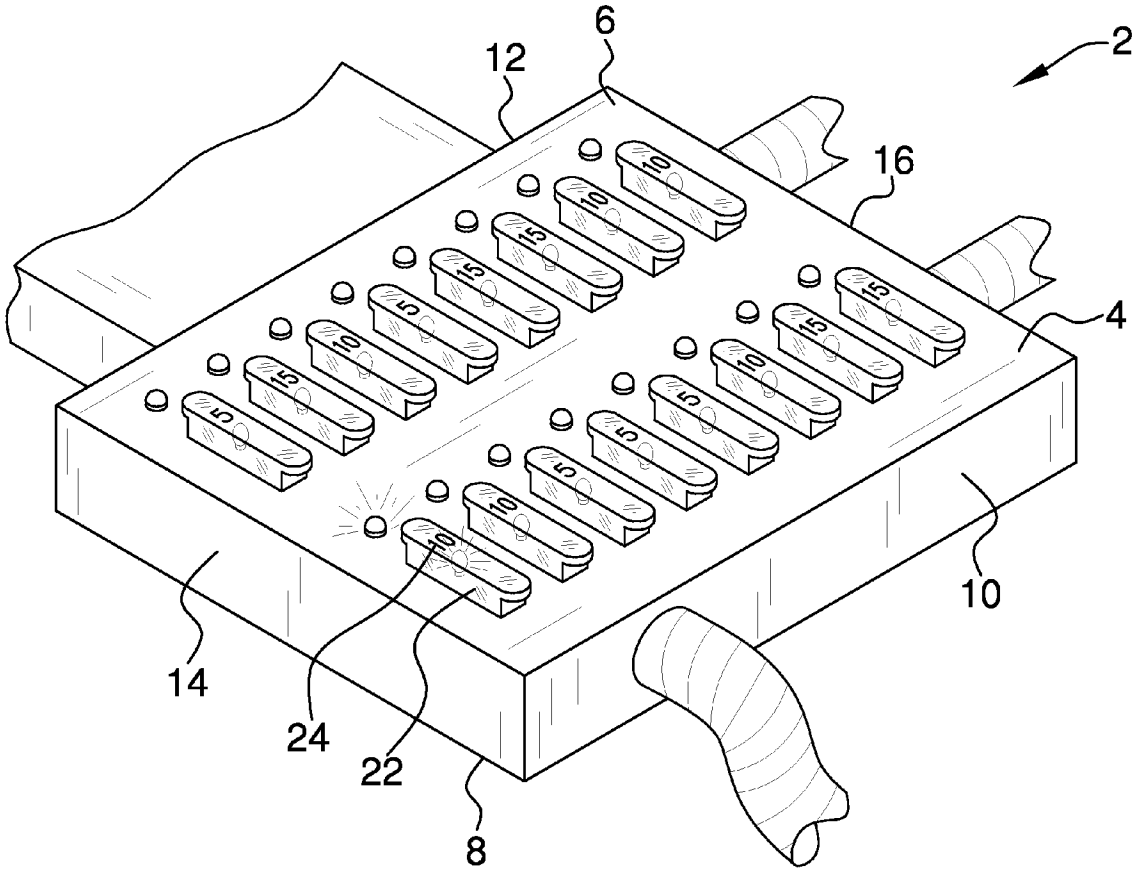

FIG. 9 is an isometric view of the embodiment shown in FIG. 5.

Figure 10:
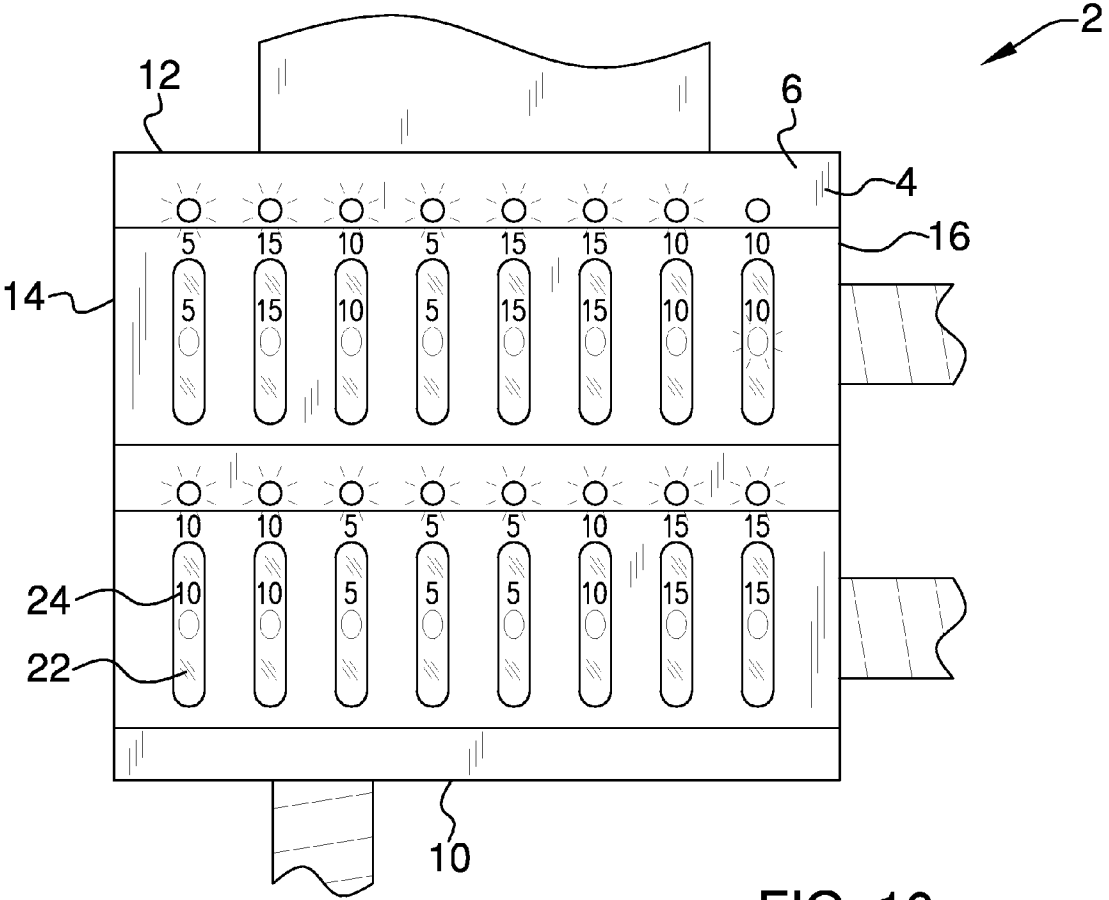

FIG. 10 is an isometric view of the embodiment shown in FIG. 6.

DESCRIPTION OF THE PREFERRED EMBODIMENT

With reference now to the drawings, and in particular to FIGS. 1 through 4 thereof, a fuse box system embodying the principles and concepts of the present invention and generally designated by the reference numeral 2 will be described.

As best illustrated in FIGS. 1 through 4, the fuse box system 2 comprises an outer casing 4 that has two surfaces comprising an upper surface 6 and a lower surface 8. The outer casing 4 also includes a front side surface 10, a rear side surface 12, a left side surface 14, and a right side surface 16.

The fuse box system 2 includes at least one incoming power line 18 and at least one outgoing power line 20. Preferably, the fuse box system 2 has three separate outgoing power lines 20.

A plurality of fuses 22 are inserted through the upper surface 6 of the outer casing 4 and partially stick out of the upper surface 6 of the outer casing 4. Each fuse has a numerical designation 24 on it to designate the particular maximum amps that it can tolerate before it will short out and need to be replaced.

Figure 3:
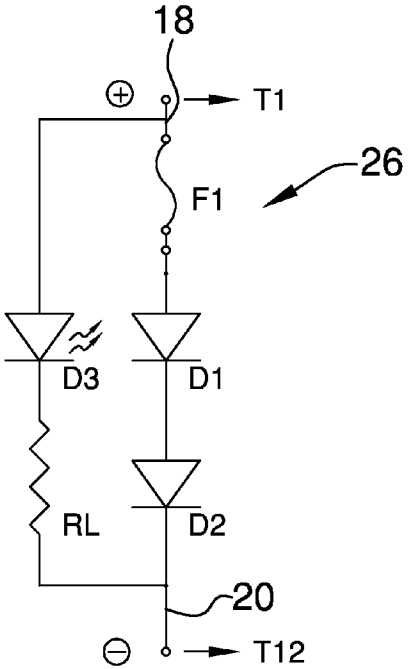
FIG. 3 shows the electronic layout located within a fuse that is used with a polarized electrical system.

In a polarized system fuse 26, as represented in FIG. 3, the incoming power line 18 inputs electricity into the fuse box system 2, while each of the outgoing power lines 20 sends power outward away from the fuse box system. In a non-polarized system, the power line designated as number 18 in FIGS. 1 and 2 can be either the incoming power line or the outgoing power line, while the power line designated as item number 20 would be the opposite that of item number 18.

In FIG. 3, the electronic schematic for the polarized system is shown. Current passes through the system from T1 to T12. Three diodes are present, designated as diodes D1, D2, and D3. D1 and D2 are shown to be in series with one another, while D3 is in parallel to D1 and D2. In series with D3 is a resistor designated as RL that acts as a current limiting resistor. D3 is a light emitting diode (LED).

Normally, current passes through D1 and D2 to the presence of less resistance. However, once D1 and/or D2 is broken or does not function, the current's only path is through "the path of greater resistance"—through D3.

Once the current passes through D3 in a large enough degree, the D3 will light up, allowing an individual to see that the polarized system fuse 26 is broken and needs to be replaced.

Figure 1:
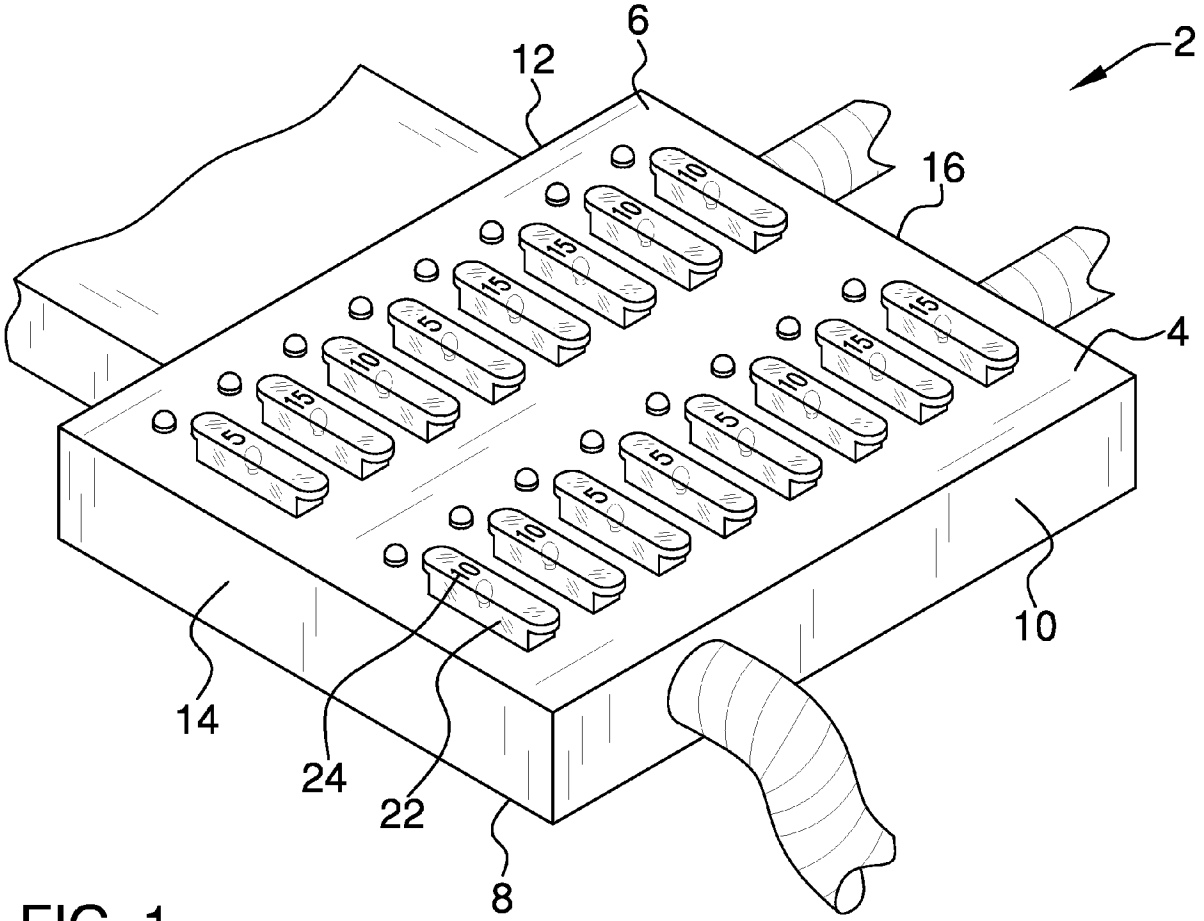
FIG. 1 shows a perspective view of the present invention.
Figure 2:
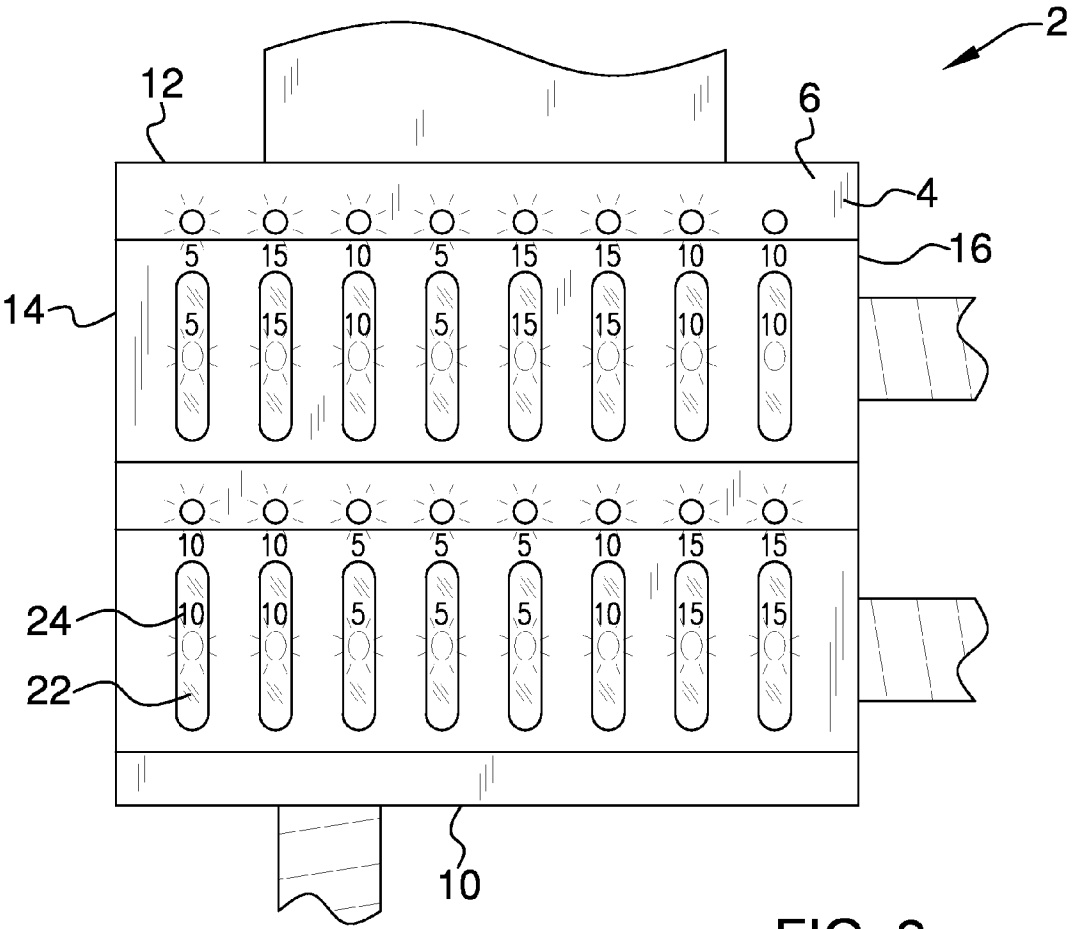
FIG. 2 shows a top view of the present invention.
Figure 4:
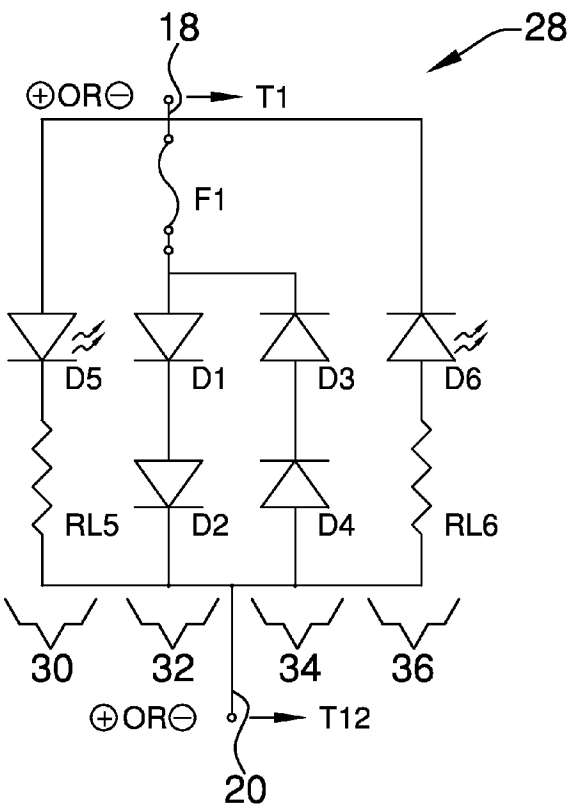
FIG. 4 shows the electronic layout located within a fuse that is used with a non-polarized electrical system.

In a non-polarized system fuse 28, as represented in FIG. 4, either the incoming power line 18 or the outgoing power line 20 inputs electricity into the fuse box system 2, while the power then exits out of the other one of the pair.

In FIG. 4, the electronic schematic for the polarized system is shown. Current passes through the system between T1 to T12 and can pass from one to the other in no particular order. Four groupings of objects are present on non-ii polarized system fuse 28, with each of these groupings being in parallel to one another. Grouping 30 includes diode D5 and current limiting resistor RLS, which are in series to one another. Grouping 32 includes diodes D1 and D2, which are in series to one another. Grouping 34 includes diodes D3 and D4, which are in series to one another. Finally, grouping 36 includes D6 and RL6, which are in series to one another. In the non-polarized system fuse 28, diodes D5 and D6 are both LED's and serve as alternative current pathways for D1 and D2 (for diode D5) and D3 and D4 (for diode D6).

Diodes D5, D1, and D2 allows current to flow from T1 to T12, while diodes D3, D4, and D6 allow current to flow from T12 to T1. Essentially, diodes D3, D4, and D6 are placed within non-polarized system fuse 28 facing the opposite way of that of diodes D5, D1, and D2.

With reference to FIGS. 5 through 10, an embodiment which utilizes only LED diodes, represented as LED 1 and LED 2 are shown. This embodiment reduces heat generated and voltage from the preferred embodiment. FIG. 5 represents the proper schematic for the fuse and/or the fuse box. The fuse will turn on/light the LED diode when the fuse is broken and the LED light to the circuit in the box to which the broken fuse is connected also turns on/lights. All other fuses and fuse box LEDs remain not lighted. This is visually represented in FIGS. 7 and 9.

FIG. 6 represents the proper schematic for a faulty lit (LED) fuse and a non-lit (LED) circuit to which the fuse was connected. All other box LEDs are ON/lighted all the time and the fuse LEDS are OFF/unlighted thus signifying a broken circuit. FIGS. 8 and 10 visually represents this schematic.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fuse box system comprising:

(a) an outer casing, said outer casing further comprising two surfaces comprising an upper surface and a lower surface, said outer casing also having four side surface comprising a front side surface, a rear side surface, a left side surface, and a right side surface;

(b) a first power line attached to said outer casing;

(c) a second power line attached to said outer casing;

(d) plurality of fuses inserted through said upper surface of said outer casing;

(e) means for notifying an individual if a fuse of said plurality of fuses is blown, said means further comprising:

(1) a light emitting diode (LED); and (2) a resistor;

wherein each fuse of said plurality of fuses has a numerical designation;

said plurality of fuses stick out partially from said upper surface of said outer casing;

said first power line comprises an incoming power line;

said second power line comprises an outgoing power line;

electricity that passes through said first power line and second power line passes through each fuse within said plurality of fuses;

said resistor and said LED are electrically connected in a series configuration;

said series configuration is electrically connected between said second power line and a power ground references;

said series configuration places said LED in a non-lit state when the respective fuse connected to said LED is blown, thereby providing the absence of light as a notification that the respective fuse is broken; and the remaining fuses within said plurality of fuses remain in a lit state when said respective fuse connected to said LED is blown.

2. The fuse box system of claim 1 wherein said current limiting resistor has a resistance of 600 ohms.

* * * * *